US011069225B1

(12) United States Patent
Chiam et al.

(10) Patent No.: US 11,069,225 B1
(45) Date of Patent: Jul. 20, 2021

(54) SYSTEM AND METHOD FOR DELAYING AN ALERT BASED ON SUSPICIOUS ACTIVITY DETECTION

(71) Applicant: MOTOROLA SOLUTIONS, INC., Chicago, IL (US)

(72) Inventors: Heng Cheng Chiam, Bukit Mertajam (MY); Choon Kang Wong, Ipoh (MY); Chee Kit Chan, Bayan Lepas (MY); Swee Yee Soo, Gelugor (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 17/106,258

(22) Filed: Nov. 30, 2020

(51) Int. Cl.

| | |
|---|---|
| ***G08B 29/00*** | (2006.01) |
| ***G08B 29/18*** | (2006.01) |
| ***G08B 3/10*** | (2006.01) |
| ***G08B 25/00*** | (2006.01) |
| *G08B 17/00* | (2006.01) |

(52) U.S. Cl.
CPC ..... *G08B 29/186* (2013.01); *G08B 3/10* (2013.01); *G08B 25/001* (2013.01); *G08B 17/00* (2013.01)

(58) Field of Classification Search
CPC ..... G08B 29/186; G08B 25/001; G08B 17/00
See application file for complete search history.

(56) References Cited

U.S. PATENT DOCUMENTS

| | | | | |
|---|---|---|---|---|
| 6,646,676 | B1 | 11/2003 | Dagraca et al. | |
| 7,847,820 | B2 | 12/2010 | Vallone et al. | |
| 8,102,251 | B2 | 1/2012 | Webb | |
| 10,670,696 | B2 | 6/2020 | Parker et al. | |
| 2011/0102588 | A1* | 5/2011 | Trundle | H04N 7/188 348/143 |
| 2017/0018167 | A1* | 1/2017 | Dey | G08B 25/008 |
| 2017/0084160 | A1* | 3/2017 | Piccolo, III | G08B 17/00 |
| 2017/0169683 | A1* | 6/2017 | Ryder | G08B 17/12 |
| 2018/0322749 | A1 | 11/2018 | Kempel et al. | |
| 2019/0007546 | A1* | 1/2019 | Anderson | H04M 1/72454 |
| 2019/0046039 | A1* | 2/2019 | Ramesh | A61B 5/0205 |
| 2020/0151326 | A1* | 5/2020 | Patrich | G06F 11/0793 |
| 2020/0211343 | A1 | 7/2020 | Mullins | |
| 2021/0112054 | A1* | 4/2021 | Bailey | H04L 63/0853 |

* cited by examiner

*Primary Examiner* — Ojiako K Nwugo

(57) ABSTRACT

Techniques for delaying an alert based on suspicious activity detection are provided. An artificial intelligence system may detect suspicious behavior of a suspect within a vicinity of a school. A responder may be dispatched to investigate the suspect. An alert signal may be temporarily delayed. A time period for the delay may be associated with a time required for the responder to investigate and a severity of the alert signal. The delay may be canceled when the responder indicates the suspect behavior is not suspicious.

20 Claims, 5 Drawing Sheets

SYSTEM AND METHOD FOR DELAYING AN ALERT BASED ON SUSPICIOUS ACTIVITY DETECTION

BACKGROUND

Mass shootings/attacks have been on the increase. For purposes of this description, a mass shooting will refer to any incident in which one or more assailants attacks a group of individuals in a somewhat confined/defined space. Some examples may include mass shootings at schools, night clubs, churches, political events, athletic events, etc. The attack may be conducted through use of firearms, explosives, chemical agents, edged weapons, etc. A general desire of the assailants is to cause as much carnage as possible.

BRIEF DESCRIPTION OF THE SEVERAL VIEWS OF THE DRAWINGS

In the accompanying figures similar or the same reference numerals may be repeated to indicate corresponding or analogous elements. These figures, together with the detailed description, below are incorporated in and form part of the specification and serve to further illustrate various embodiments of concepts that include the claimed invention, and to explain various principles and advantages of those embodiments

Figure 1:
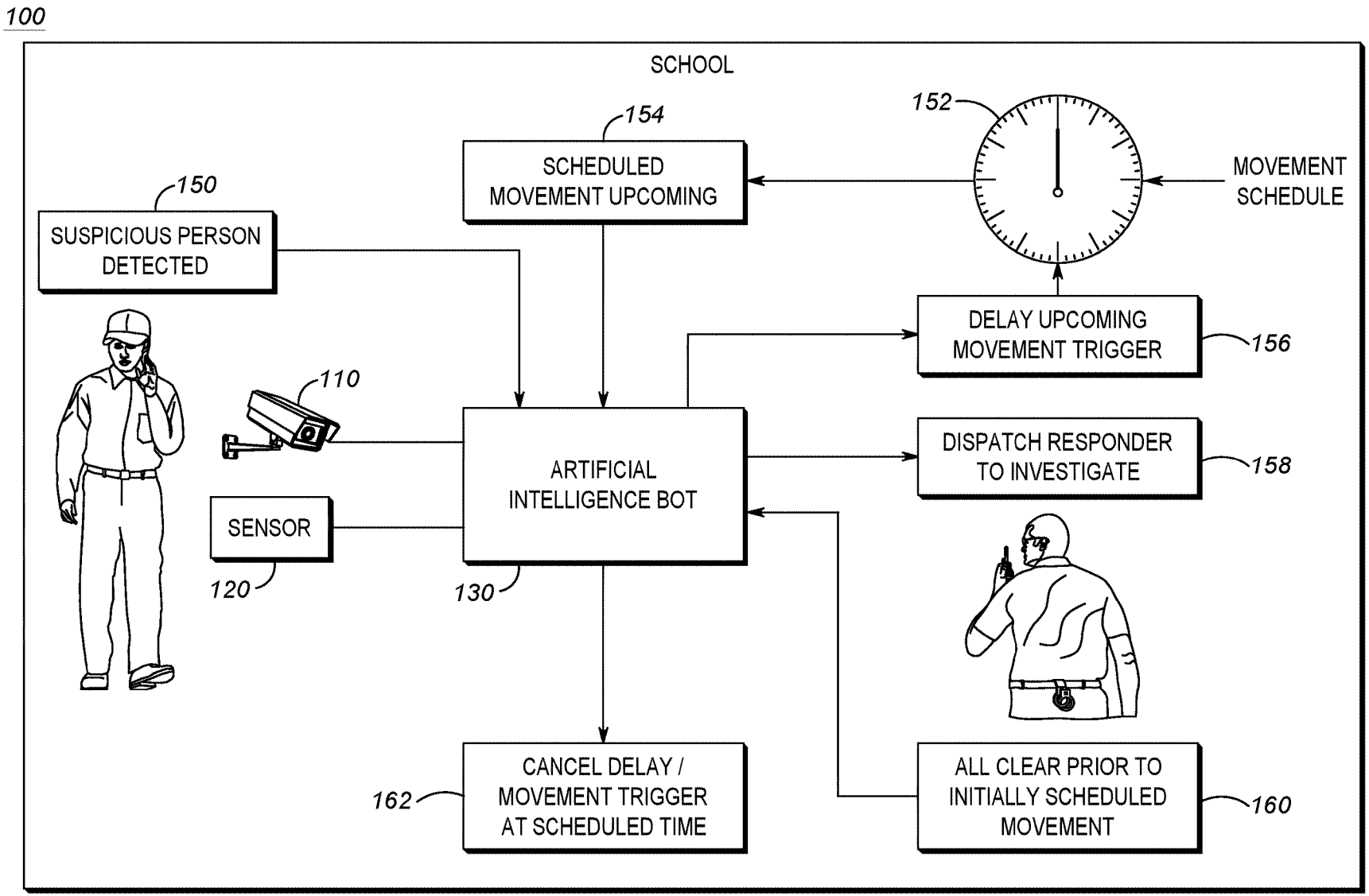
FIG. 1 is an example environment in which the delaying an alert based on suspicious activity detection techniques described herein may be implemented.

Skilled artisans will appreciate that elements in the figures are illustrated for simplicity and clarity and have not necessarily been drawn to scale. For example, the dimensions of some of the elements in the figures may be exaggerated relative to other elements to help improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Although mass shootings are tragic wherever they occur, mass shootings in schools are especially tragic. Schools often include the youngest and most vulnerable members of a population who may be the least capable of defending themselves. Furthermore, the very nature of the school structure may further exacerbate the problems with defending against mass shootings.

As mentioned above, the goal of assailant(s) in a mass shooting is to cause as much carnage as possible. In order to do this, an assailant may plan their attack for a predictable time, when the most targets are available, and the locations of those targets are generally known. Schools tend to operate in such a structured manner. A bell may indicate the start of classes, when all students are expected to be in a classroom. A passing period stop/start bell may indicate when students are expected to transition from one classroom to the next, and it can be expected that the majority of students will be in the hallways, moving between classes. Likewise, an end of day dismissal bell may indicate when all students will be leaving their classrooms and be in the hallways in preparation to leave the building for the day. Schools operate on schedules, so the timing of these various bells is well known.

In several recent cases, a school assailant intentionally delayed the start of their attack to coincide with a period of time when the maximum number of students would present themselves as targets within the hallways. This was relatively easy to do because of the nature of the known schedule of a school.

In yet other cases, the assailant may themselves trigger a condition that would cause large numbers of students to present themselves as targets. For example, if all students are in their classrooms, a reduced number of targets may be available (e.g. once shots are heard, students are trained to lock themselves in the classroom). However, if a fire alarm is triggered (e.g. assailant pulls fire alarm), students are trained to immediately leave the classroom to exit the building. Thus the process of evacuating the building causes the students to flood the hallways thus presenting themselves as targets.

The techniques described herein overcome these problems and others, individually and collectively. An Artificial Intelligence (AI) bot monitors surveillance cameras for detection of suspicious activity within the school grounds. Upon detection of suspicious activity, a security officer is dispatched to investigate the suspicious activity.

The AI system determines if there are any scheduled events that would cause students to become vulnerable targets (e.g. passing period bell, dismissal bell, etc.). If so, the system may delay such bell until the dispatched officer is able to confirm that the suspicious activity does not pose a threat. If it is determined there is no threat prior to the originally scheduled event, the delay is canceled, and the event occurs as originally scheduled. If it cannot be determined that no threat exists, an alternative action may be taken. For example, instead of sounding a dismissal bell, a lockdown alert may occur.

The same techniques could be used with an assailant triggered event. For example, if the AI bot detects a suspicious person, the AI bot may monitor fire alarms within the area of the suspicious person. If a fire alarm is pulled in such an area, the alarm may be temporarily delayed for a short period of time in order to allow a security officer to check to determine if a true fire is occurring. If the security officer is unable to confirm that an emergency does not exist within this short period of time or a secondary indicator (e.g. smoke detector, heat sensor, etc.) indicates there is an actual emergency during the delay, the fire alarm may sound. If the security officer is able to confirm that no incident exists, the fire alarm may be canceled, and an alternative action (e.g. enter lockdown) may be executed.

Although the description above has been presented in terms of a school, it should be understood that the techniques are not so limited. For example, the techniques may be used in an environment in which scheduled movements occur (e.g. prison, factory with defined shift changes, etc.). The techniques could also be used in any environment which includes assailant accessible controls (e.g. fire alarms) that can be activated by the assailant to trigger movement of people within the environment. For ease of description only, the remainder of the disclosure will be described in terms of a school environment.

A method is provided. The method includes detecting, via an artificial intelligence system, suspicious behavior of a suspect within a vicinity of a school. The method further includes dispatching a responder to investigate the suspect. The method also includes temporarily delaying an alert signal, a time period of the delay associated with a time required for the responder to investigate and a severity of the alert signal. The method additionally includes canceling the delay when the responder indicates the suspect behavior is not suspicious.

In one aspect, the alert signal is at least one of a school dismissal bell and a school passing period bell. In one aspect, the method includes initiating an alternative response when the responder has indicated the suspect behavior is suspicious. In one aspect, the time period for the delay is further based on an alert signal schedule, wherein the time period for the delay is selected such that no additional alert signal is scheduled during the time period for the delay.

In one aspect the alert signal is a fire alarm signal. In one aspect, the delay is only applied to fire alarm signals within an immediate vicinity of the suspect. In one aspect the method includes initiating an alternative response when the responder has indicated the suspect behavior is suspicious.

A system is provided. The system includes a processor and a memory coupled to the processor. The memory contains a set of instructions thereon that when executed by the processor cause the processor to detect suspicious behavior of a suspect within a vicinity of a school. The instructions further cause the processor to dispatch a responder to investigate the suspect. The instructions further cause the processor to temporarily delay an alert signal, a time period of the delay associated with a time required for the responder to investigate and a severity of the alert signal. The instructions further cause the processor to cancel the delay when the responder indicates the suspect behavior is not suspicious.

In one aspect, the alert signal is at least one of a school dismissal bell and a school passing period bell. In one aspect the instructions further cause the processor to initiate an alternative response when the responder has indicated the suspect behavior is suspicious. In one aspect the time period for the delay is further based on an alert signal schedule, wherein the time period for the delay is selected such that no additional alert signal is scheduled during the time period for the delay.

In one aspect the alert signal is a fire alarm signal. In one aspect, the delay is only applied to fire alarm signals within an immediate vicinity of the suspect. In one aspect the instructions further cause the processor to initiate an alternative response when the responder has indicated the suspect behavior is suspicious.

A non-transitory processor readable medium containing a set of instructions thereon is provided. The medium contains a set of instructions thereon that when executed by a processor cause the processor to detect suspicious behavior of a suspect within a vicinity of a school. The instructions further cause the processor to dispatch a responder to investigate the suspect. The instructions further cause the processor to temporarily delay an alert signal, a time period of the delay associated with a time required for the responder to investigate and a severity of the alert signal. The instructions further cause the processor to cancel the delay when the responder indicates the suspect behavior is not suspicious.

In one aspect, the alert signal is at least one of a school dismissal bell and a school passing period bell. In one aspect the medium further includes instructions to initiate an alternative response when the responder has indicated the suspect behavior is suspicious. In one aspect the time period for the delay is further based on an alert signal schedule, wherein the time period for the delay is selected such that no additional alert signal is scheduled during the time period for the delay.

In one aspect the alert signal is a fire alarm signal. In one aspect the medium further includes instructions to initiate an alternative response when the responder has indicated the suspect behavior is suspicious.

Further advantages and features consistent with this disclosure will be set forth in the following detailed description, with reference to the figures.

FIG. 1 is an example environment in which the delaying an alert based on suspicious activity detection techniques described herein may be implemented. FIG. 1 depicts an environment 100, which may be an environment such as a school. Although the remainder of this description is described in terms of a school environment, it should be understood that the techniques are not so limited.

Environment 100 may include a plurality of cameras 110, additional sensors 120, and an AI bot 130. An example of a device that may implement the AI bot 130 is described with respect to FIG. 5.

It should be understood that environment 100 may include any number of many different types of sensors that may be used to detect suspicious activity within environment 100. One common example of such a sensor may be a surveillance camera 110. Surveillance cameras may be placed in strategic locations around a school. For example, cameras could be placed that monitor all entrances and exits to the school. Cameras could be placed that cover the exterior of the school. Cameras may be placed that cover interior aspects of the school, such as hallways, classrooms, and offices. For purposes of this description, cameras may be placed in any location where students and/or staff may be where there is not an expectation of privacy (e.g. restrooms, locker rooms, etc.).

Cameras 110 can be of many different types. For example, cameras may be fixed cameras which have a defined Field of View (FoV) that cannot be changed remotely. Other cameras may be Pan-Tilt-Zoom cameras in which the FoV may be adjusted remotely. Yet another type of camera may be a body worn camera that may be worn by school security personnel or even teachers/administrators within the school. What should be understood is that any type of camera that may monitor the school environment may be utilized by the techniques described herein.

Cameras 110 may be coupled to an Artificial Intelligence bot 130. The AI bot may utilize know techniques to detect suspicious persons and activity. For example, there are known AI techniques to detect unusual motion that could be considered suspicious. For example, in a school context, a person wandering in the hallways or entering/exiting the school building during a time when class is in session could be flagged as suspicious, because it would be expected that during class, all students would be in a classroom, not in the hallways or by exterior doors.

In some cases, the AI bot 130 and cameras 110 could be coupled to a facial recognition system to identify faces of people captured by the camera. Once identified, a database could be checked to determine if the identified person may be a threat because they should not be on the school grounds (e.g. suspended/expelled student, former student, adult who is legally prohibited from being near a school, wanted persons, etc.). Once a person is identified, any number of different data sources could be check to determine if that person poses a threat. The techniques described herein are applicable for all such data sources.

The facial recognition system could also be used to detect persons that are deliberately trying to conceal their identities (e.g. wearing a mask, etc.). Someone near a school who is attempting to conceal their identity may be suspicious. Techniques are available to detect persons wearing suspicious clothing (e.g. camouflage clothing, body armor, etc.) that may be suspicious in a school environment.

AI techniques are also known for detecting objects that a person may be carrying. In the simplest case, object classifiers are available to detect weapons, such as guns and knives. Persons carrying such items near/into a school may be flagged as suspicious. Additional classifiers are available to detect items people are carrying that, although are not prohibited, appear out of place. For example, a person carrying a large duffel bag into a school may be considered suspicious, because the bag may be large enough to contain long guns, such as assault rifles.

In addition to cameras 110, environment 100 may also include any number of other types of sensors 120 that may be used to detect suspicious persons. For example, access controlled doors with keycard readers may be a type of sensor. Attempted access by a prohibited person whose access privileges have been revoked/suspended (e.g. suspended/expelled student, former student, terminated teacher, etc.) could be detected by the door access control sensor.

There may be other types of sensors 120 as well. For example, there may be fire detection sensors, such as heat detectors, smoke sensors, oxygen sensors, chemical attack sensors, etc. These sensors may be utilized to trigger an evacuation alarm when triggered, as conditions within the school may no longer be safe. In addition to automated sensors, manually activated sensors may also exist. For example, a fire alarm that can be manually activated if a fire is detected. As will be explained in further detail below with respect to FIG. 3, a manual fire alarm is only able to convey that a person has activated the alarm. It is not able to convey that an emergency condition (e.g. fire, etc.) actually exists and is real.

The AI bot 130 may utilize information from cameras 110 and sensors 120 to detect suspicious persons 150 on the school grounds as described above. For example, the AI bot may detect that a student who is listed as suspended has just entered the building carrying a large duffel bag during a period of time when students should already be in class.

Because there is a suspicious person detected, the AI bot 130 may consult a movement schedule 152 (e.g. daily schedule) to determine if there are any scheduled movements upcoming 154 in the near future. For example, if all students are currently in class, the hallways should be clear. However, there may be a scheduled passing period in the near future (e.g. 15 minutes) during which all students will enter the halls to switch classrooms. The risk of injury/death at the hands of the suspicious person may be greater if large numbers of students are in the halls as opposed to remaining in their classrooms.

The AI bot 130 may decide to delay the upcoming movement trigger 156. For example, in many schools, movement triggers may be bells that indicate the time. There may be a warning bell to indicate when students should be heading to their first class. There may be a class start bell to indicate students not in their designated classrooms are tardy. There may be a passing period bell to indicate students should move to their next class. There may be a dismissal bell to indicate that the school day has ended and students are free to leave the school. In the present example, the AI bot may decide to delay the passing period by 15 minutes from its scheduled time (e.g. bell will not sound for 30 minutes). Furthermore, it should be understood that if another movement trigger was scheduled during the period of delay (e.g. in 20 minutes), that movement trigger would be delayed as well to avoid having that movement trigger occur during the delay period.

The AI bot 130 may then cause a responder to be dispatched to investigate 158. For example, the responder may be a security guard, law enforcement, designated school staff, etc. In some cases, the AI bot may be in direct communication with the dispatched responder. For example, the responder may carry a portable two-way radio (e.g. walkie talkie) over which assignments may be received. The AI bot may be able to interface directly with the radio system in order to directly dispatch the responder.

In other cases, the AI bot 130 may be coupled to a control center (not shown) which may be in radio contact with the responder. In yet other cases, the responder may periodically check with the AI bot to determine if there are any suspicious persons that have been detected. It should be understood that the particular communications method is not important. What should be understood is that the responder is informed that there is a suspicious person.

In addition to informing the responder that there is a suspicious person, the AI bot 130 may provide details describing where the person is and why the person is suspicious (e.g. suspicious person, student listed as suspended, carrying large duffel bag, entering school through external door, while all students should be in a classroom). The AI bot may also inform the responder that the scheduled movement trigger (e.g. bell) has been delayed and the period of time for the delay (e.g. 30 minutes).

The responder may then proceed to investigate the suspicious person. It may turn out the suspicious person is not a threat. In the present example, the indication the student was suspended may be incorrect (e.g. data error, etc.), the bag he was carrying was innocuous (e.g. large bag carrying sporting equipment, etc.), and the reason he was not in class was legitimate (e.g. arriving to school late due to a planned doctor's appointment, etc.).

The responder may then inform the AI bot 130 that all is clear prior to the initially scheduled movement 160. In some implementations, the responder may have direct communication with the AI bot, and directly informs the AI bot that there is no need for concern and that all is clear. In some implementations, the AI bot may monitor the radio communications of the responder to listen for an all clear signal, indicating there is no need for concern. In yet other implementations, a control center may inform the AI bot that there is no longer a need for concern. Regardless of how informed, the AI bot is made aware that there is no longer a reason to consider the person suspicious.

For example, the initially scheduled movement may have been 15 minutes from the time the responder was dispatched. If the responder is able to confirm that there is no cause for concern, the AI bot may cancel the delay and allow the movement trigger to occur at its normally scheduled time 162. In other words, to the students, it does not appear that there was a delay at all, because the movement trigger occurred at the expected time.

In some cases, it may be determined that the suspicious person is not a concern, but the determination does not happen until after the scheduled time for the movement trigger has passed. In such cases, the movement trigger may be immediately activated once it is determined that there is no concern. Movement triggers may then return to their normal schedule. In some cases, it might not be possible to confirm if there is or is not a concern with the suspicious person before the period of delay has expired. In such cases, the delay may be extended to allow the responder to have additional time to investigate.

Figure 2:
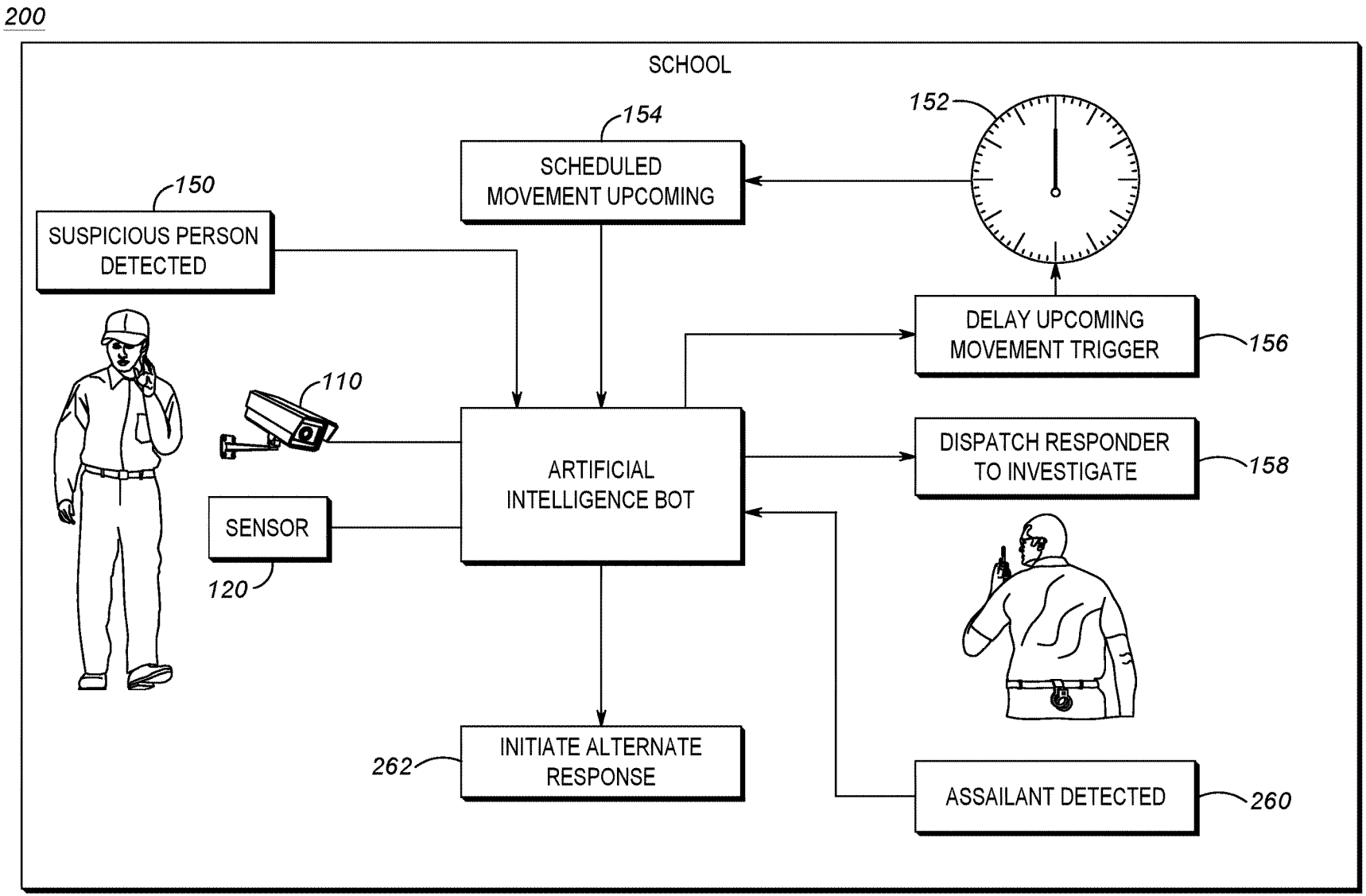
FIG. 2 is another example environment in which the delaying an alert based on suspicious activity detection techniques described herein may be implemented.

FIG. 2 is another example environment in which the delaying an alert based on suspicious activity detection techniques described herein may be implemented. FIG. 2 depicts an environment 200 that is very similar to environment 100 described in FIG. 1. Similar elements are numbered the same. The difference between FIG. 1 and FIG. 2 occurs after the responder is dispatched.

In FIG. 2, it may be determined that the suspicious person is actually a detected assailant 260 that intends to do some harm to people in the school. In the present example, the student may in fact be currently suspended. The large bag may indeed contain fire arms. The student may have no legitimate reason to be in the school at that specific time. The responder may inform the AI bot 130 that a true threat has been detected. The responder may inform the AI bot through any of the same mechanisms that were described with respect to FIG. 1 when reporting the all clear 160.

The AI bot 130 may then initiate an alternate response 262. For example, instead of proceeding with the normal, scheduled movement trigger (e.g. bell), the AI bot may cause a lockdown alarm to be initiated. During a lockdown, students and staff have been trained to lock themselves in a secure area (e.g. class room, office, etc.) and potentially barricade the doors. By preventing the students from flooding the hallways, the number of potential targets for the suspicious person is drastically decreased.

Figure 3:
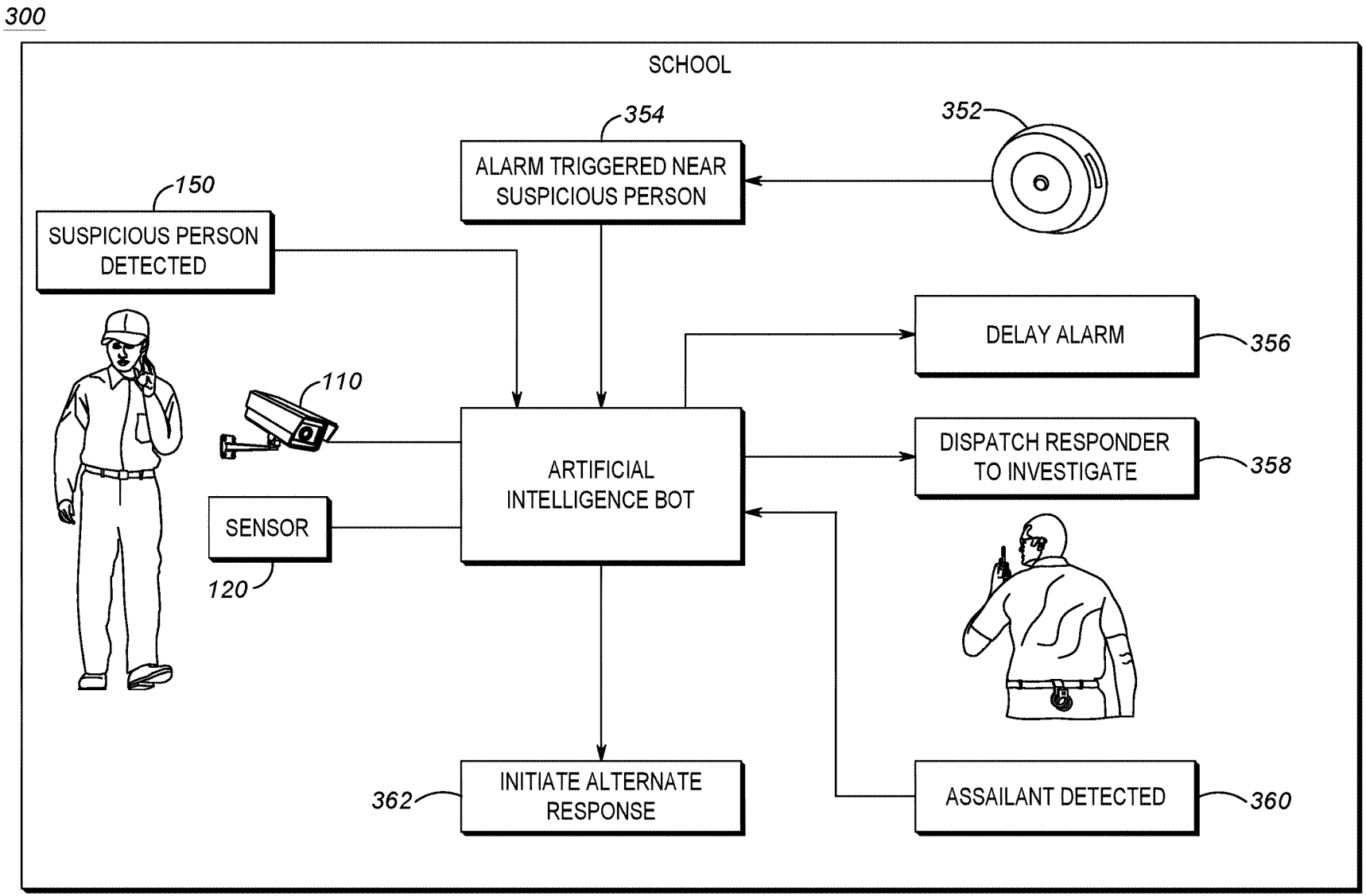
FIG. 3 is another example environment in which the delaying an alert based on suspicious activity detection techniques described herein may be implemented.

FIG. 3 is another example environment in which the delaying an alert based on suspicious activity detection techniques described herein may be implemented. FIG. 3 depicts an environment 300 that is very similar to environment 100 described in FIG. 1. Similar elements are numbered the same. Just as in FIG. 1 and FIG. 2, a suspicious person 150 may be detected.

There may be a manually activated alarm, such a fire alarm 352 that is in the vicinity of the suspicious person. For example, most school have fire alarms that can be pulled by a person if a fire or other emergency is suspected. However, manual activation of the alarm is no guarantee that an emergency exists. The AI bot 130 may become aware that an alarm, such as a fire alarm, has been triggered near the suspicious person 354. In the case of a manual alarm, the AI bot does not know for sure if the alarm that was triggered is reporting a real emergency or is an attempt by the suspicious person to cause a building evacuation. During a building evacuation, students would leave the relative safety of their classrooms and enter the hallways to evacuate, thus presenting themselves as targets to the suspicious person.

The AI bot 130, just as above, may delay the alarm 356. The AI bot may dispatch a responder to investigate 358 the triggered alarm to determine if the alarm is in fact real and is associated with an actual emergency event. Unlike the examples described with respect to FIG. 1 and FIG. 2, the responder may be given a very short time to confirm that there is or is not an emergency. The reason for this is because in the previous cases, the worst case scenario is that students are held in a classroom beyond a scheduled time. However, in the case of a manually triggered fire alarm, holding students within the classroom could be dangerous if the emergency turns out to be real.

In some implementations, the delay to the alarm may only be executed if the alarm is a manually triggered alarm. If a sensor 120 (e.g. smoke, heat, chemical agent, etc.) detects an actual emergency condition, the delay may be canceled because an actual emergency exists. Although it is possible that the suspicious person has created the emergency (e.g. set a fire in the hallway, etc.) in order to trigger an evacuation, the existence of an actual threat (e.g. fire) may outweigh the benefits of holding students within their classrooms. In other implementations, even an actual sensor detected emergency may cause a delay in the alarm until the responder can investigate.

The responder may determine that an assailant has been detected 360 and report that information to the AI bot 130. Just as above, the AI bot may then cause an alternative response 362 to be initiated. For example, instead of evacuating the building, the school may go into a lockdown, wherein all students lock themselves in their classrooms.

In some implementations, the delay on a manually triggered alarm applies only to alarms within the immediate vicinity of the suspicious person. For example, if a suspicious person is detected at one end of the building, but the fire alarm is manually pulled at the opposite end of the build, it is less likely that the alarm is an attempt by the suspicious person to lure students out of the classrooms. The immediate vicinity may be considered to be anything within reach of the suspicious person, within a specified distance from the suspicious person (e.g. within 25 feet, etc.), or could be anywhere the suspicious person could move to within a period of time (e.g. anywhere the suspicious person could go within 30 seconds, etc.).

Although the examples described in FIGS. 1-3 relate to a single suspicious person, the techniques described herein are not so limited. For example, a first suspicious person may be detected (e.g. person carrying a large bag). Within a short period of time, a second suspicious person may have been detected attempting to pull the fire alarm. The AI bot may delay the fire alarm while a responder is dispatched to investigate the second suspicious person.

In the meantime, the AI bot 130 may continue to monitor the first suspicious person. If the responder determine the fire alarm triggered by the second suspicious person was false, the AI bot may cancel the fire alarm. A responder may then be dispatched to investigate the first suspicious person. If it turns out the first suspicious person is actually a threat, an alternative action, such as a lockdown, may be triggered.

Figure 4:
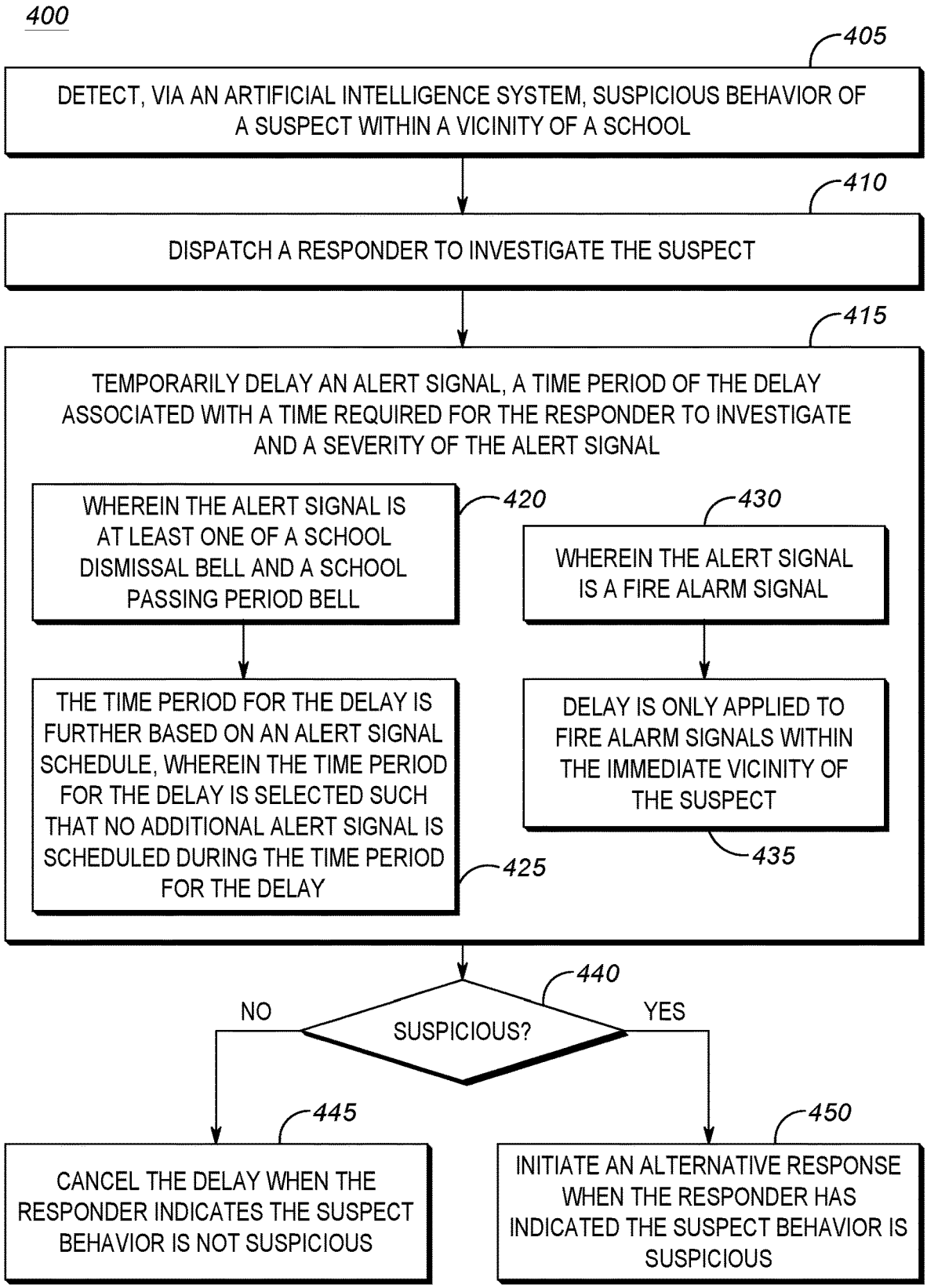
FIG. 4 is an example flow diagram of an implementation of the delaying an alert based on suspicious activity detection techniques described herein.

FIG. 4 is an example flow diagram 400 of an implementation of the delaying an alert based on suspicious activity detection techniques described herein. In block 405, an artificial intelligence system may detect suspicious behavior of a suspect within a vicinity of a school. For example, the AI system may be an implementation of the AI bot 130. As described above, there are many know techniques using AI to detect the presence of suspicious persons, based on presence, actions, clothing, object detection, etc. The AI system may detect any such suspicious person within the vicinity of a school.

In block 410, a responder may be dispatched to investigate the suspect. AS mentioned above, the AI is simply detecting individuals that may be suspicious and that may warrant further investigation. Detecting a suspicious person does not necessarily mean that the person has done anything wrong and there could be legitimate reasons for whatever it is that caused the person to be flagged as suspicious. Dispatching a responder to investigate can determine if the suspicion is warranted.

In block 415, an alert signal can temporarily be delayed, the time period for the delay associated with a time required for the responder to investigate and a severity of the alert signal. The time period of the delay will be described in further detail with respect to blocks 420-435.

Block 420 describes one example of an alert signal. In block 420, the alert signal is at least one of a school dismissal bell and a school passing period bell. Both of these types of alert signals are scheduled events within the school day. In addition, they are both alert signals that would cause students to leave the relative safety of a classroom and venture into less protected areas, such as school hallways.

In block 425, the time period for the delay is further based on an alert signal schedule, wherein the time period for the delay is selected such that no additional alert signal is scheduled during the time period of the delay. In other words, one aspect of the time of delay for a scheduled bell is that it will also delay any other bells scheduled within that time period. For example, if a bell is scheduled to sound in 15 minutes and a second bell is scheduled to sound in 25 minutes, selecting a delay of 15 minutes for the first bell would additionally cause the second bell to not sound during the time of delay for the first bell. In short, any other bell scheduled to sound during the delay period for the first delay would also be delayed. Because the impact of delaying the bell is only that students remain in a classroom, the delay is not that alert signal is not that severe. As such, the delay period can be selected to be a larger delay.

Block 430 describes a different type of alert signal. In block 430, the alert signal is a fire alarm signal. As explained above, schools include fire alarm signals that may be activated (e.g. pulled) by a human to indicate an emergency condition. A suspicious person may pull a fire alarm to cause students to flee the classroom in order to evacuate the building. Introducing a delay between the pulling of the fire alarm and the sounding of the alert allows time for the responder to investigate if the fire alarm pull is real or not.

Given that a fire alarm is more severe than a school bell, the amount of time for a delay of the fire alarm may be reduced. For example, if the responder cannot determine for sure within a defined, short period of time that the alarm is not true, then the alert signal should be sounded. In some implementations, if a secondary indication of a true emergency situation is received (e.g. heat sensor, smoke sensor) indicating that an actual physical fire is occurring is received, the delay may be canceled and the alert signal sounded. In other implementations, the delay may remain until the responder confirms if there is a true emergency or not.

In block 435, the delay is only applied to fire alarm signals within the immediate vicinity of the suspect. For example, if a suspicious person is detected at one end of the building, and a fire alarm at the opposite end of the building is triggered, it is highly unlikely that the two are related. As such, there should be no delay in sounding the alert. However, if the fire alarm is triggered nearby the suspicious person, there is a greater chance the alarm trigger is not real and is an attempt to lure students out of their classrooms into the hallways.

In block 440, a determination may be made by the responder if the person is suspicious. This determination may be sent back to the AI system. Several techniques for informing the AI system have been described above. What should be understood is that a determination is made if the suspicious person is truly a concern.

If there is no concern, in block 445, the delay is canceled when the responder indicates the suspect behavior is not suspicious. The clearly being if there is no concern about the person, there is no reason to continue the delay. If in block 440 it is determined the person is suspicious, the process moves to block 450. In block 450 an alternate response is initiated when the responder has indicated the suspect behavior is suspicious. For example, rather than sounding the bell to dismiss students or sounding the fire alarm to cause students to evacuate the building, a lockdown alert may be sent causing students to lock themselves in their classrooms. Other alternate responses are also possible.

Figure 5:
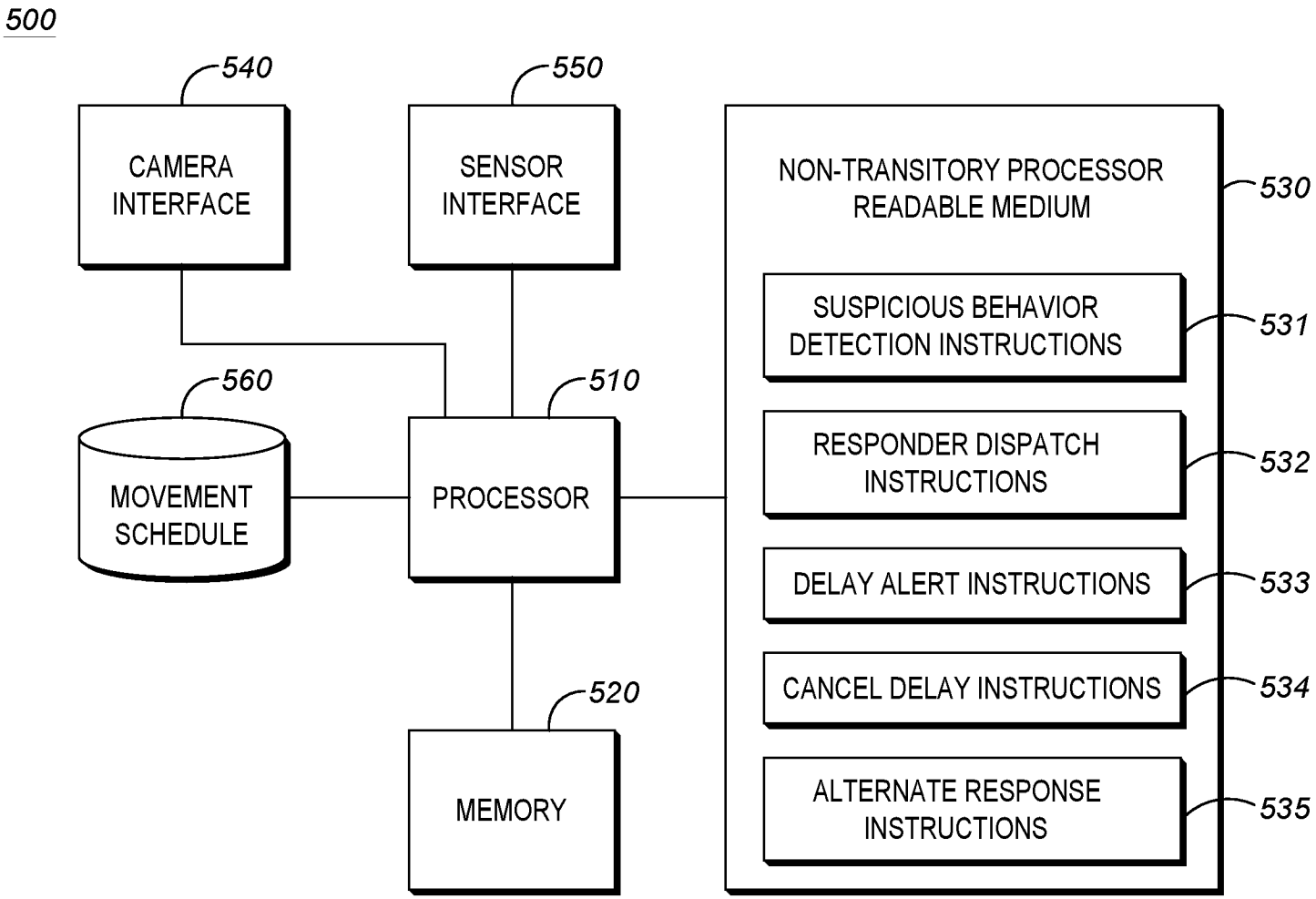
FIG. 5 is an example of a device that may implement the delaying an alert based on suspicious activity detection techniques described herein.

FIG. 5 is an example of a device that may implement the delaying an alert based on suspicious activity detection techniques described herein. For example, a device that may implement AI bot 130. It should be understood that FIG. 5 represents one example implementation of a computing device that utilizes the techniques described herein. Although only a single processor is shown, it would be readily understood that a person of skill in the art would recognize that distributed implementations are also possible. For example, the various pieces of functionality described above (e.g. video analytics, sensor analytics, etc.) could be implemented on multiple devices that are communicatively coupled. FIG. 5 is not intended to imply that all the functionality described above must be implemented on a single device.

Device 500 may include processor 510, memory 520, non-transitory processor readable medium 530, camera interface 540, sensor interface 550, and movement schedule database 560.

Processor 510 may be coupled to memory 520. Memory 520 may store a set of instructions that when executed by processor 510 cause processor 510 to implement the techniques described herein. Processor 510 may cause memory 520 to load a set of processor executable instructions from non-transitory processor readable medium 530. Non-transitory processor readable medium 530 may contain a set of instructions thereon that when executed by processor 510 cause the processor to implement the various techniques described herein.

For example, medium 530 may include suspicious behavior detection instructions 531. The suspicious behavior detection instructions may cause the processor to detect that a person within the vicinity of a school is behaving suspiciously. For example, the device 500 may access cameras monitoring the school through camera interface 540 or other sensors throughout the school using sensor interface 550. As explained above, there are known algorithms that may use such camera and sensor data to detect suspicious behavior, and those algorithms may be implemented by the suspicious behavior detection instructions. The suspicious behavior detection instructions are described throughout this description generally, including places such as the description of block 405.

Medium 530 may also include responder dispatch instructions 532. The responder dispatch instructions may be used to cause a responder to investigate the circumstances surrounding the detected suspicious person. The responder dispatch instructions may also allow for the responder to provide the device 500 with the determination of if the suspicious behavior detected is in fact behavior that is of concern. The responder dispatch instructions are described throughout this description generally, including places such as the description of blocks 410 and portions of blocks 445-450.

Medium 530 may also include delay alert instructions 533. The delay alert instructions may be used to determine if an alert signal should be delayed and, if so, for how long. The delay alert instructions may also be used to determine which triggers are subject to a delay and which ones are not. The delay alert instructions are described throughout this description generally, including places such as the description of blocks 415-435.

Medium 530 may also include cancel delay instructions 534 which may be used to determine when the delay for an alert is canceled. The cancel delay instructions are described throughout this description generally, including places such as portions of the description of block 445. Medium 530 may also include alternate response instructions 535 which may be used to initiate a response that is different from the one normally triggered by the alert (e.g. instead of ringing the dismissal bell, enter lockdown, etc.). The alternate response instructions 535 are described throughout this description generally, including places such as portions of the description of block 450.

As should be apparent from this detailed description, the operations and functions of the electronic computing device are sufficiently complex as to require their implementation on a computer system, and cannot be performed, as a practical matter, in the human mind. Electronic computing devices such as set forth herein are understood as requiring and providing speed and accuracy and complexity management that are not obtainable by human mental steps, in addition to the inherently digital nature of such operations (e.g., a human mind cannot interface directly with RAM or other digital storage, cannot transmit or receive electronic messages, electronically encoded video, electronically encoded audio, etc., and cannot [include a particular function/feature from current spec], among other features and functions set forth herein).

Example embodiments are herein described with reference to flowchart illustrations and/or block diagrams of methods, apparatus (systems) and computer program products according to example embodiments. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. The methods and processes set forth herein need not, in some embodiments, be performed in the exact sequence as shown and likewise various blocks may be performed in parallel rather than in sequence. Accordingly, the elements of methods and processes are referred to herein as "blocks" rather than "steps."

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions may also be loaded onto a computer or other programmable data processing apparatus to cause a series of operational blocks to be performed on the computer or other programmable apparatus to produce a computer implemented process such that the instructions which execute on the computer or other programmable apparatus provide blocks for implementing the functions/acts specified in the flowchart and/or block diagram block or blocks. It is contemplated that any part of any aspect or embodiment discussed in this specification can be implemented or combined with any part of any other aspect or embodiment discussed in this specification.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "one of", without a more limiting modifier such as "only one of", and when applied herein to two or more subsequently defined options such as "one of A and B" should be construed to mean an existence of any one of the options in the list alone (e.g., A alone or B alone) or any combination of two or more of the options in the list (e.g., A and B together).

A device or structure that is "configured" in a certain way is configured in at least that way, but may also be configured in ways that are not listed.

The terms "coupled", "coupling" or "connected" as used herein can have several different meanings depending in the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through an intermediate elements or devices via an electrical element, electrical signal or a mechanical element depending on the particular context.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Any suitable computer-usable or computer readable medium may be utilized. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. In the context of this document, a computer-usable or computer-readable medium may be any medium that can contain, store, communicate, propagate, or transport the program for use by or in connection with the instruction execution system, apparatus, or device.

Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. For example, computer program code for carrying out operations of various example embodiments may be written in an object oriented programming language such as Java, Smalltalk, C++, Python, or the like. However, the computer program code for carrying out operations of various example embodiments may also be written in conventional procedural programming languages, such as the "C" programming language or similar programming languages. The program code may execute entirely on a computer, partly on the computer, as a stand-alone software package, partly on the computer and partly on a remote computer or server or entirely on the remote computer or server. In the latter scenario, the remote computer or server may be connected to the computer through a local area network (LAN) or a wide area network (WAN), or the connection may be made to an external computer (for example, through the Internet using an Internet Service Provider).

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method comprising:

detecting, via an artificial intelligence system, suspicious behavior of a suspect within a vicinity of a school;

dispatching a responder to investigate the suspect;

temporarily delaying an alert signal, a time period of the delay associated with a time required for the responder to investigate and a severity of the alert signal; and canceling the delay when the responder indicates the suspect behavior is not suspicious.

2. The method of claim 1 wherein the alert signal is at least one of a school dismissal bell and a school passing period bell.

3. The method of claim 2 further comprising:

initiating an alternative response when the responder has indicated the suspect behavior is suspicious.

4. The method of claim 1 wherein the time period for the delay is further based on an alert signal schedule, wherein the time period for the delay is selected such that no additional alert signal is scheduled during the time period for the delay.

5. The method of claim 1 wherein the alert signal is a fire alarm signal.

6. The method of claim 5 wherein the delay is only applied to fire alarm signals within an immediate vicinity of the suspect.

7. The method of claim 6 further comprising:

initiating an alternative response when the responder has indicated the suspect behavior is suspicious.

8. A system comprising:

a processor; and a memory coupled to the processor, the memory containing a set of instructions thereon that when executed by the processor cause the processor to:

detect suspicious behavior of a suspect within a vicinity of a school;

dispatch a responder to investigate the suspect;

temporarily delay an alert signal, a time period of the delay associated with a time required for the responder to investigate and a severity of the alert signal; and cancel the delay when the responder indicates the suspect behavior is not suspicious.

9. The system of claim 8 wherein the alert signal is at least one of a school dismissal bell and a school passing period bell.

10. The system of claim 9 further comprising instructions to:

initiate an alternative response when the responder has indicated the suspect behavior is suspicious.

11. The system of claim 8 wherein the time period for the delay is further based on an alert signal schedule, wherein the time period for the delay is selected such that no additional alert signal is scheduled during the time period for the delay.

12. The system of claim 8 wherein the alert signal is a fire alarm signal.

13. The system of claim 12 wherein the delay is only applied to fire alarm signals within an immediate vicinity of the suspect.

14. The system of claim 13 further comprising instructions to:

initiate an alternative response when the responder has indicated the suspect behavior is suspicious.

15. A non-transitory processor readable medium containing a set of instructions thereon that when executed by a processor cause the processor to:

detect suspicious behavior of a suspect within a vicinity of a school;

dispatch a responder to investigate the suspect;

temporarily delay an alert signal, a time period of the delay associated with a time required for the responder to investigate and a severity of the alert signal; and cancel the delay when the responder indicates the suspect behavior is not suspicious.

16. The medium of claim 15 wherein the alert signal is at least one of a school dismissal bell and a school passing period bell.

17. The medium of claim 16 further comprising instructions to:

initiate an alternative response when the responder has indicated the suspect behavior is suspicious.

18. The medium of claim 15 wherein the time period for the delay is further based on an alert signal schedule, wherein the time period for the delay is selected such that no additional alert signal is scheduled during the time period for the delay.

19. The medium of claim 15 wherein the alert signal is a fire alarm signal.

20. The medium of claim 19 further comprising instructions to:

initiate an alternative response when the responder has indicated the suspect behavior is suspicious.

* * * * *